US012013131B2

(12) United States Patent
Sinico et al.

(10) Patent No.: US 12,013,131 B2
(45) Date of Patent: Jun. 18, 2024

(54) EXPANSION VESSEL WITH MEMBRANE, PUMP COMPRISING THE EXPANSION VESSEL AND RELATIVE MANUFACTURING METHOD

(71) Applicant: DAB PUMPS S.P.A., Mestrino (IT)

(72) Inventors: Francesco Sinico, Mestrino (IT); Fabiano Puccioni, Mestrino (IT); Luca Calore, Mestrino (IT)

(73) Assignee: DAB PUMPS S.P.A., Mestrino (IT)

( * ) Notice: Subject to any disclaimer, the term of this patent is extended or adjusted under 35 U.S.C. 154(b) by 0 days.

(21) Appl. No.: 17/816,368

(22) Filed: Jul. 29, 2022

(65) Prior Publication Data

US 2024/0035673 A1 Feb. 1, 2024

(51) Int. Cl.

| | |
|---|---|
| ***F24D 3/10*** | (2006.01) |
| ***B65D 1/46*** | (2006.01) |
| ***B65D 83/00*** | (2006.01) |

(52) U.S. Cl.

CPC ..... *F24D 3/1016* (2013.01); *B65D 1/46* (2013.01); *B65D 83/0055* (2013.01); *F24D 2220/0278* (2013.01)

(58) Field of Classification Search

CPC ... F17C 2201/018; B65D 88/128; B65D 1/46; B65D 83/0055; F24D 3/1016; F24D 2220/0278

See application file for complete search history.

(56) References Cited

U.S. PATENT DOCUMENTS

| | | | | |
|---|---|---|---|---|
| 3,931,834 | A * | 1/1976 | Caillet | F24D 3/1008 138/30 |
| 5,386,925 | A * | 2/1995 | Lane | F24D 3/1008 220/721 |
| 5,984,132 | A * | 11/1999 | Dinouard | F17C 1/12 220/23.91 |
| 6,129,236 | A * | 10/2000 | Osokin | F15B 1/14 222/386.5 |
| 6,199,717 | B1 * | 3/2001 | Tsai | F24D 3/1016 220/723 |
| 2005/0017016 | A1 * | 1/2005 | Lombari | F24D 3/1008 220/721 |
| 2006/0131314 | A1 * | 6/2006 | Lombari | B29C 66/53262 220/721 |
| 2017/0261158 | A1 * | 9/2017 | Cogliati | F17C 13/002 |

FOREIGN PATENT DOCUMENTS

| | | |
|---|---|---|
| EP | 0790411 A1 | 6/1997 |
| EP | 1582820 A2 | 10/2005 |
| EP | 3217100 A1 | 9/2017 |

OTHER PUBLICATIONS

Italian Search Report dated Dec. 12, 2021 for Italian Patent Application No. 102021000005756.

* cited by examiner

*Primary Examiner* — Kareen K Thomas
(74) *Attorney, Agent, or Firm* — Knobbe Martens Olson and Bear LLP

(57) ABSTRACT

Disclosed is an expansion vessel for containing and delivering a liquid through compression by a gas, comprising a main body, a membrane, an inlet for the entry of the liquid and a valve for the inlet of the gas. The first edge has a substantially "L" shape. Disclosed also is a pump for systems which comprises the expansion vessel and a method for making the above-mentioned expansion vessel.

13 Claims, 5 Drawing Sheets

EXPANSION VESSEL WITH MEMBRANE, PUMP COMPRISING THE EXPANSION VESSEL AND RELATIVE MANUFACTURING METHOD

TECHNICAL FIELD

This disclosure relates to the field of expansion vessels with a membrane, in particular it relates to an expansion vessel made of plastic, with a membrane.

BACKGROUND

The manufacture of an expansion vessel with a membrane that is simultaneously resistant to temperature changes, non-toxic when in contact with drinking water, while maintaining sufficient strength, is currently a major problem since creating and assembling such expansion vessels is complex to implement due to various and different structural limitations.

It is particularly important especially in the field of household and civil plumbing systems to control pressure variations due to temperature differences or abrupt changes in flow (so-called water hammer), as expansion vessels commonly prevent such variations from being absorbed by the system, which could be damaged.

Moreover, the expansion vessels can act as a water reservoir for small withdrawals, with a corresponding reduction in the number of system pump starts, also in the event of leaks.

There are currently expansion vessels on the market that can be used in various sectors, for example: in the above-mentioned plumbing systems for the water supply for civil use, to compensate for pressure variations due to temperature differences or water hammer; in automobile cooling circuits to compensate for the effects of thermal expansion; in irrigation systems, both to avoid water hammer and to facilitate pressure regulation, and in hydraulics.

Among the types of expansion vessels currently used, there are the open-type expansion vessels and the closed-type expansion vessels, which may have different shapes and sizes.

In particular, the closed-type expansion vessel consists of a rigid container usually made of materials such as aluminium, cast iron, fibreglass, etc., divided into two caps welded together; there are two chambers of variable volume in the expansion vessel, one chamber containing the fluid of the circuit (water, almost incompressible), the other chamber containing air or gas (compressible) loaded at a certain pressure by means of a special valve. There is a partition between the two chambers comprising a bag or elastic membrane (also defined as "lung").

The two variants most commonly used for this type of expansion vessel differ in terms of the positioning and operation of the membrane inside the vessel.

In the first of these variants, the expansion vessel consists of an outer casing (in cast iron, fibreglass, aluminium, etc.), a membrane, a water inlet and an air inlet; in particular, the membrane is connected to the water inlet and can vary its volume inside the expansion vessel due to the change in pressure in the adjacent chamber caused by the inflow or outflow of gas, in the latter case by taking water into the chamber and advantageously ensuring that the water itself never comes into contact with the metal walls of the vessel. However, when the expansion vessel is not used, for example during storage, the membrane, which is empty, collapses inside it, bending; over time, the bending lines can become fault lines, both because of the characteristics of the elastomeric material of which the membrane is made and the cyclic nature of the stress it is subjected to.

According to the second variant, the expansion vessel also consists of an outer casing (made of cast iron, fibreglass, aluminium, etc.), a membrane, a water inlet and an air inlet; in particular, the membrane is connected to the air inlet, resulting in an increase or decrease in the volume occupied by water, outside the membrane and inside the walls of the expansion vessel. In this case, when the expansion vessel is not used, the membrane is fully extended and full of air, in contact with the walls of the casing. While avoiding the above-mentioned problems deriving from the collapse of the membrane itself, this solution has the disadvantage of having the water in direct contact with the walls of the vessel while it is being used, increasing the risk of contamination and consequent toxicity.

Furthermore, nowadays, in order to make the expansion vessels and, in particular, the area of the fluid/water inlet, the injection molding technique is often used, during which, once the optimal area in which to mold the component has been selected, the molten plastic material is injected, at high pressure, into the mold. Once the necessary cooling time has passed, this mold is opened to allow the extraction of the molded piece.

The pieces thus obtained require ancillary operations such as, merely by way of example, the removal of the superfluous material given by the injection attachments, defined as sprue, the elimination of possible burrs caused by the molding and the execution of any holes for the fluid inlet, as in the case under analysis.

A common characteristic of the two variants is that expansion vessels, especially the larger ones, must be resistant and strong enough to withstand their own weight, depending on the cases, to contain a certain amount of water therein and to support the motor connected to the vessels themselves. Moreover, a common drawback of the variants described is related to the construction requirements, which require the presence of a welding line between the two caps that make up the outer casing of the expansion vessel. Although the presence of such a welding line makes it possible to simplify processes such as, for example, the transport of the vessel and the assembly/disassembly of the membrane, cyclic rubbing between the welding line and the membrane can cause cracks along its surface.

SUMMARY

Within the above-mentioned requirements, therefore, the main aim of some embodiments of the disclosure is to make an expansion vessel with a membrane capable of overcoming the technical drawbacks mentioned above and, in particular, to make an expansion vessel with a membrane that is safe from the point of view of water contamination and at the same time durable over the years.

A further aim of some embodiments of the disclosure is to make an expansion vessel with a membrane that is strong enough.

Another aim of some embodiments of this disclosure is to make an expansion vessel that is compatible with contact with drinking water.

A further aim of some embodiments of the disclosure is to make an expansion vessel in such a way as to facilitate processes such as, for example, the detection of any foreign bodies trapped inside it or the checking from the outside of any cracks of the membrane.

A further aim of the some embodiments of disclosure is to make an expansion vessel that allows its interior to be viewed entirely without blind spots and, at the same time, to shield the UV rays to avoid the proliferation of microorganisms inside it, such as, merely by way of example, legionella. Another aim of some embodiments of the disclosure is to make an expansion vessel with a membrane that is easily transportable, resistant to sudden temperature changes and UV rays.

Another aim of some embodiments of the disclosure is to make an expansion vessel with a membrane such as to be simpler to manufacture.

A further aim of some embodiments of the disclosure is to obtain an expansion vessel with a membrane which is simple and economical to make with respect to the advantages achieved.

Another aim of some embodiments of the disclosure is to make an expansion vessel having a structure such as to optimize the containment of the loads and, more generally, the withstanding of the external stresses which it will encounter.

Not least, an aim is to provide an expansion vessel with a membrane for which it is possible to check the compensation activity of the air volume, without the aid of any instrumentation.

These and other aims are achieved by an expansion vessel with a membrane according to the disclosure, as will better emerge later in this description.

Preforms have been known for some time in the production of plastic material vessels, consisting of semi-finished products used in particular in blow-molding processes, and have a body with a more or less elongated tubular structure with a closed end.

At the opposite end there is a mouth, of variable diameter, the size of which remains unchanged at the end of the process. The above-mentioned mouth, in order to be used, favouring the injection of the fluid/water inside the expansion vessel, requires ancillary operations such as the removal of the excess material due to the injection attachments, that is to say, the sprue.

The body, on the other hand, precisely because of the nature of the process, undergoes a reduction in wall thickness during blowing, which will be all the greater, the greater the final volume of the vessel.

Such preforms, however, have the drawback of not being designed to contain a membrane or an air inlet valve, thus being unsuitable to act as an expansion vessel.

Another drawback is the size of traditional preforms, which are limited to a relatively small volume, unsuitable for making expansion vessels with a capacity of at least 20 litres.

In an advantageous way, the plastic material expansion vessel with a membrane can be made substantially from a preform of non-blown polymeric material, such as PET (polyethylene terephthalate) which is suitable for contact with drinking water and is non-toxic and sufficiently robust.

The object of some embodiments of the disclosure is therefore an expansion vessel for containing and dispensing a liquid, by means of compression by a fluid, comprising a main body having a first and a second end and having, at the first end, an edge protruding from the main body itself.

Again advantageously, the above-mentioned first edge has a substantially "L" shape in such a way as to delimit, with the main body, a compartment which is provided with an opening facing towards the second end, defining a plane perpendicular to the main body.

Furthermore, the compartment in question comprises a plurality of reinforcing ribs which are recessed with respect to said plane (A) which have a substantially curvilinear profile in such a way as to increase the resistance to any external stresses that the expansion vessel will encounter during its use.

Furthermore, the expansion vessel in question also comprises a sprue, resulting from the injection attachment of the plastic for its manufacture, and at least two equidistant holes placed around said sprue.

Advantageously, the above-mentioned holes are such as to guarantee the centering of the male-matrix part of the mold for making the main body; in order to allow the injection of the plastic material during the formation of the main body and to allow the entry/exit of the liquid, in particular water, inside the expansion vessel, during the operation.

Moreover, according to a preferred embodiment of the expansion vessel according to some embodiments of the disclosure, there are three holes, in such a way as to guarantee the sturdiness of the mold, allowing the possible stresses of the system to be divided in a balanced manner.

Advantageously, the main body comprises, at the second end, a mouth for the inlet of the liquid around which there are a plurality of support means, equidistant from each other, such as to allow a better response of the expansion vessel to any external stresses.

The expansion vessel according to some embodiments of the disclosure comprises inside it a membrane provided with a second edge.

Moreover, the expansion vessel in question, at the first edge of the main body, comprises the second edge of the membrane and, also, a substantially elliptical shaped steel covering cap having a third edge, with a larger diameter than the cap itself, such as to structurally follow the profile of the edge of the main body itself. Moreover, the second edge of the cap comprises a hooked flap for engaging the cap to the first edge of the main body.

Advantageously, the main body of the expansion vessel in question comprises a valve for the gas inlet; the above-mentioned cap further comprises a central hole for the insertion of the valve for the gas inlet into the expansion vessel.

Advantageously, in the area between the flap of the cap and the edge of the main body there is a steel ring in such a way as to strengthen the structure of said cap.

Moreover, again advantageously, at the area between the cap and the membrane itself, a second plastic ring is arranged to hold the membrane in position with respect to the cap during operation of the expansion vessel.

Again, the main body can be made in one piece so as to present a smooth surface internally, so as to avoid rubbing of the membrane that could cause damage.

In this case, the main body can comprise integrated supporting means, which allow it to be supported when in use.

A pump for plants can advantageously comprise the expansion vessel described above.

Lastly, the method for manufacturing the expansion vessel, according to some embodiments of the disclosure, advantageously comprises the following steps:

- injection molding of the molten plastic, at high pressure, inside a mold, with the creation of a main body equipped with a sprue;
- making at least two holes equidistant from the sprue, close to the sprue itself, designed for inserting the plastic material inside the mold to form the main body of the expansion vessel in question;

centering the male-matrix of the mold on the above-mentioned at least two holes;

cooling of the melted plastic inside the mold and opening of the mold for the extraction of the expansion vessel thus created;

insertion of the membrane in the seat at the edge of the main body itself;

compression and rolling of the edge with the ring or closure by molding and/or pressing welding of the main body and of the cap;

permanent closure of the cap, previously equipped/prepared with a valve for inserting the gas.

BRIEF DESCRIPTION OF THE DRAWINGS

Further features and advantages of the plastic material expansion vessel with membrane according to some embodiments of this disclosure will be more apparent from the following description, referring to three variants of preferred and exemplifying, but not limiting, embodiments, and from the accompanying drawings, wherein.

DETAILED DESCRIPTION

With reference to the drawings mentioned, the expansion vessel with a membrane is made of plastic material such as, merely by way of example, PET (polyethylene terephthalate).

In particular, according to a first embodiment of the disclosure, the expansion vessel made of plastic material with a membrane 4 (FIGS. 1-6, 13A-13C) comprises a transparent or at least partially transparent main body 1.

The main body 1 in question has two ends: at the first end there is an inlet 2 for liquid, for example water, which can be positioned below the installation position of the vessel, while at the second end there is a valve 3 for the gas inlet, for example air, which can be positioned above the installation position of the vessel.

Advantageously, it is the expansion vessel as a whole that is at least partially transparent and therefore not only a part/portion thereof.

In detail, the expansion vessel in question, since it consists in its entirety of at least partially transparent-plastic materials, such as PET—has the following advantages: the possibility of viewing inside it, evaluating the presence of foreign bodies and/or the possible rupture of the membrane at any point, in addition to the possibility of acting as a filter, on its entire surface, for example for UV rays, avoiding the proliferation of agents harmful for the safety of the water, such as legionella.

Figure 1A:
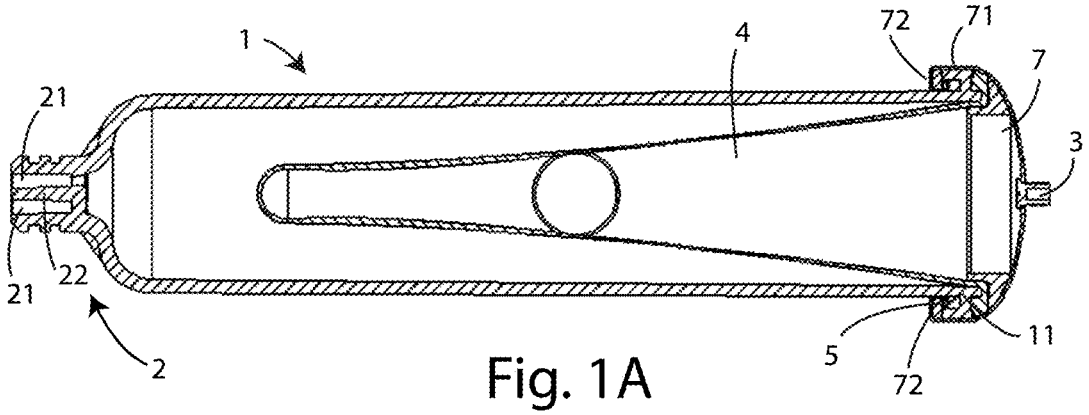
FIG. 1A shows a longitudinal sectional view of the expansion vessel with a membrane.

Furthermore, the inlet 2 for liquid, as can be seen in detail in FIG. 1, has at least two equidistant holes 21, made directly during the formation of the main body, in such a way as to guarantee a triple function: the centering of the male-matrix part of the mold for making the main body, allowing the injection of the plastic material during the formation of the main body and allowing the entry/exit of the liquid, in particular water, inside the expansion vessel, to guarantee its operations.

Advantageously, this solution allows, unlike what has already been described in the prior art, an expansion vessel to be made starting from a main body made of semi-transparent plastic, allowing the effective entry of the liquid, through the above-mentioned holes 21, without the need for having an ancillary step of removing the injection sprue 22, with all the advantages described above.

Moreover, according to a preferred embodiment of the expansion vessel, there are three holes 21, guaranteeing the sturdiness of the mold and allowing the possible stresses of the system to be divided in a balanced manner. In particular, the above-mentioned three holes 21 are located, as can be seen in FIG. 4, positioned around the above-mentioned injection sprue 22.

Figure 4:
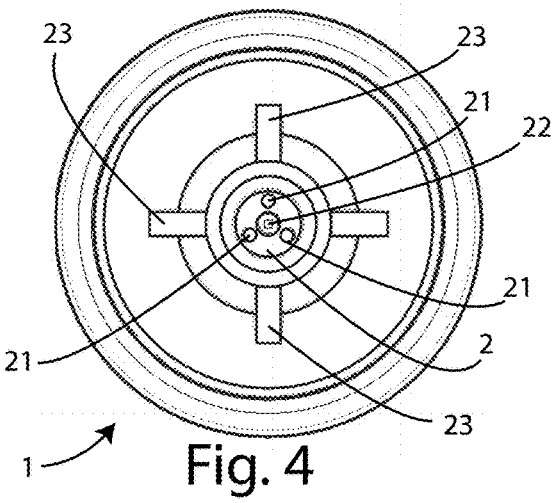
FIG. 4 is a front view of the expansion vessel of FIG. 1, with the detail of the liquid inlet.
Figure 5:
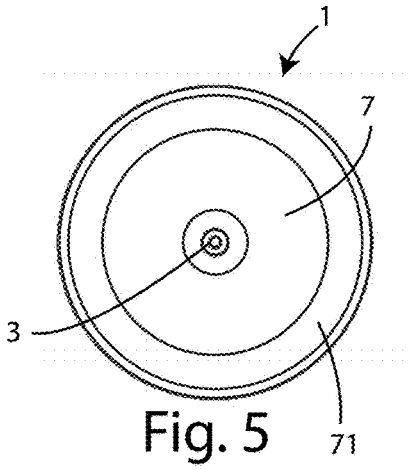
FIG. 5 is a front view relating to the detail of the gas inlet valve, of the expansion vessel of FIG. 1.

As shown, again in FIG. 4, substantially around the base of the inlet 2 for the inlet of the liquid (from the side opposite to the holes 21), there are a plurality of support means 23, possibly equidistant from each other, such as for example ribs. Due to their position, these ribs allow optimization of the response of the expansion vessel to the external stresses it will encounter. In the upper part of the main body 1, at the valve 3 for the gas inlet, there is a projecting element 11, hereinafter also defined as an edge, having a larger diameter than the main body 1 itself, at which the membrane 4 is fixed.

Figure 1B:
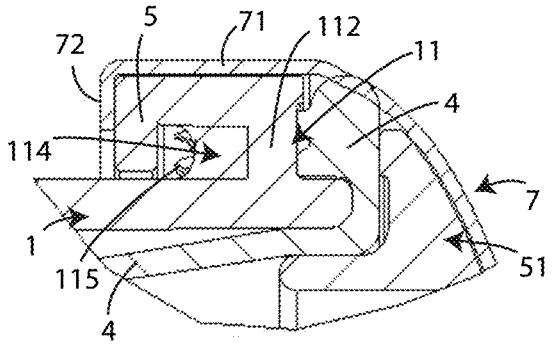
FIG. 1B shows a detail relating to the area of the edge of the expansion vessel of FIG. 1A wherein the relative membrane and cap are arranged.
Figure 1C:
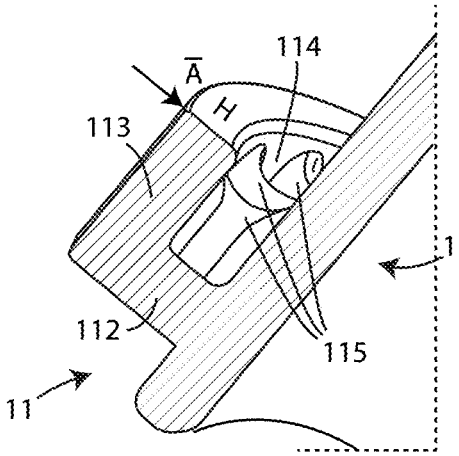
FIG. 1C is a perspective view of the edge of the expansion vessel of FIG. 1A.
Figure 2:
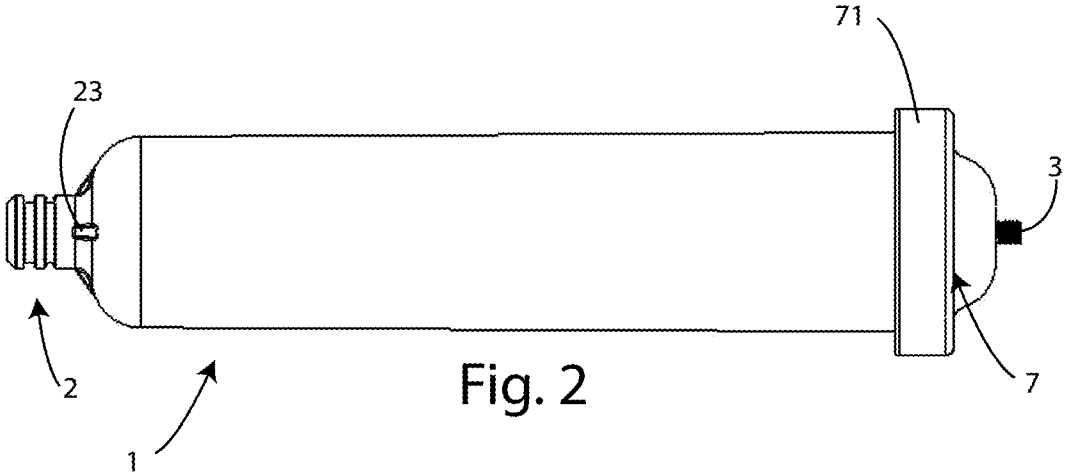
FIG. 2 is a side view of the expansion vessel of FIG. 1.
Figure 13A:
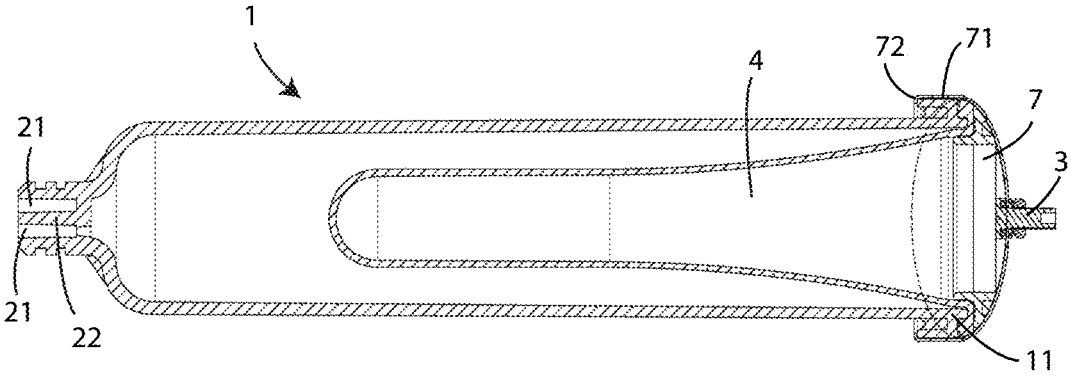
FIG. 13A shows a longitudinal sectional view of the expansion vessel with a membrane.
Figure 13B:
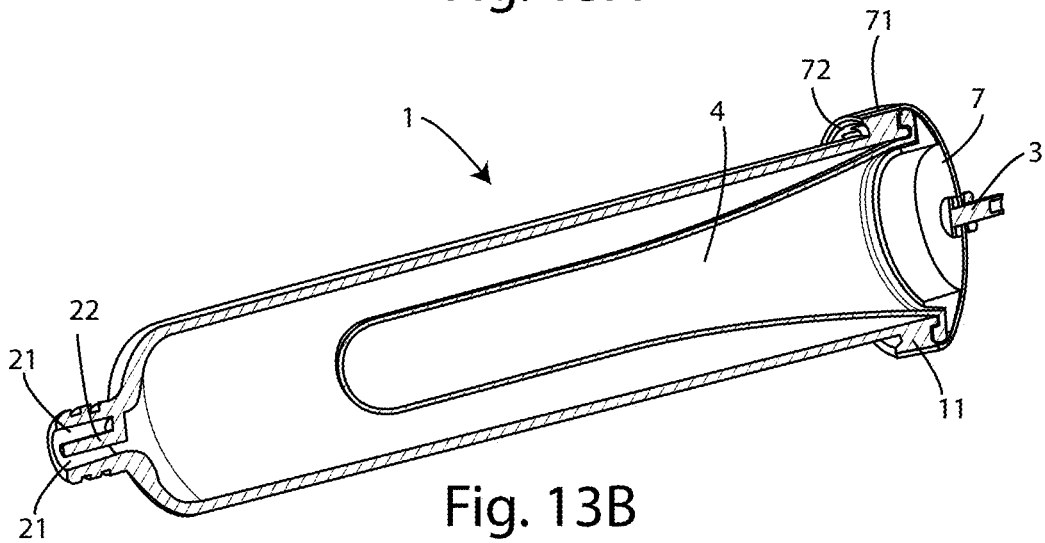
FIG. 13B is a perspective view of the expansion vessel of FIG. 13A.
Figure 13C:
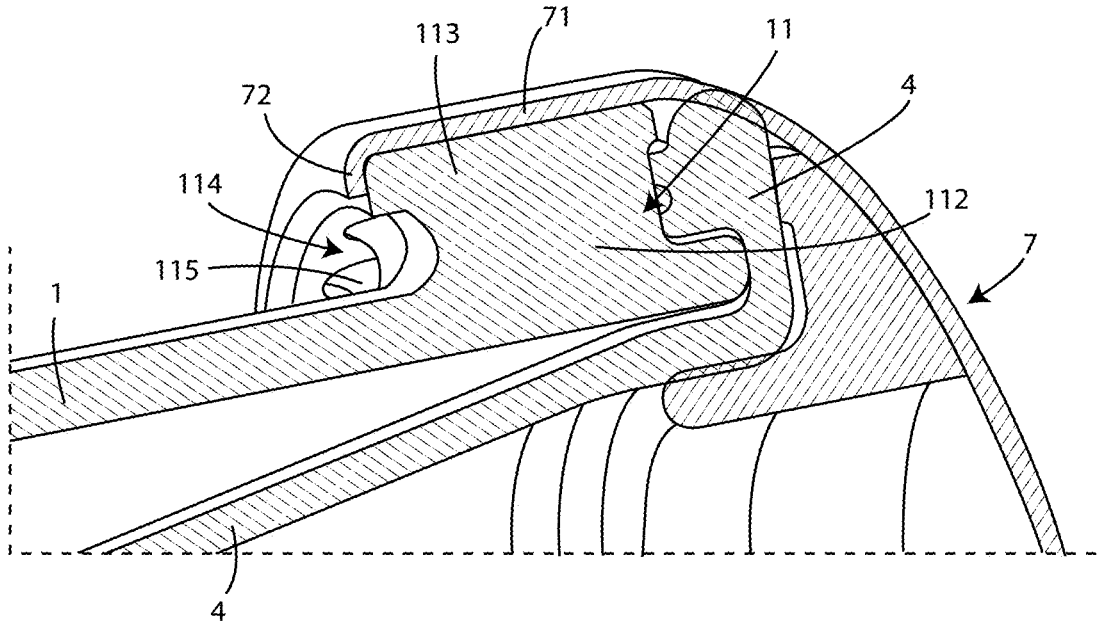
FIG. 13C is a perspective view of the edge of the expansion vessel of FIG. 13A.

In particular, as visible in FIGS. 1B, 1C and 13C, the edge 11 has a substantially "L" shape having: a first portion 112 outgoing and perpendicular to the main body 1 and a second portion 113, contiguous and perpendicular to the first portion 112.

In other words, the second portion 113 extends substantially parallel to the main body 1 (FIG. 1C) delimiting, with the main body 1, a compartment 114 of the edge 11 in which there are a plurality of reinforcing ribs 115; in essence, the compartment 114 has a "U" shape with the opening facing towards the inlet 2, in which the bottom of the compartment 114 is formed by the first portion 112 and its walls are formed, respectively, by the second portion 113 and by the main body 1.

Furthermore, the above-mentioned second portion 113 has a thickness H measured on a plane A, perpendicular to the main body 1.

Advantageously, the ribs 115 located in the compartment 114 of the edge 11 are partial and recessed lowered with respect to the plane A and therefore with respect to the second portion 113 of the edge 11 (FIG. 1C, 13C).

Figure 3B:
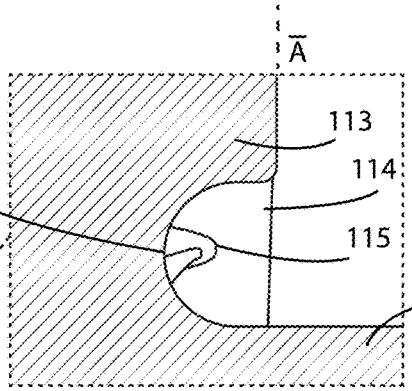
FIG. 3B is an enlargement of a detail of the edge of the expansion vessel of FIG. 3A.
Figure 3A:
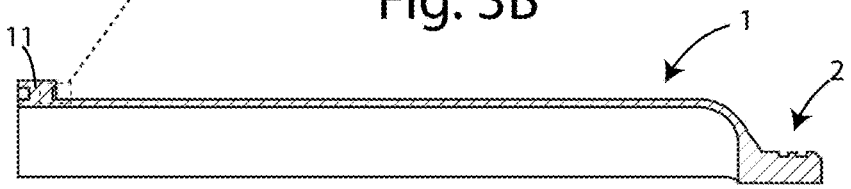
FIG. 3A is a detail of a longitudinal sectional view of the expansion vessel.

These ribs therefore have a substantially concave profile, preferably circular or elliptical, as can be seen in detail in FIG. 3B, in such a way as to ensure a greater resistance for the expansion vessel as a whole.

Again advantageously, the ribs 115, precisely because of their recessed geometry with respect to the edge 11, are such as to withstand and discharge in an optimum manner the external stresses which the expansion vessel in question will encounter.

Moreover, a curved type geometry, for example elliptical or circular, allows to structurally create fittings that are able to guide and, therefore, to discharge an applied external stress, which does not happen for other types of geometries, such as polygonal ones, the angles of which, under stress, are to be considered as invitations to for system failure.

Figure 7:
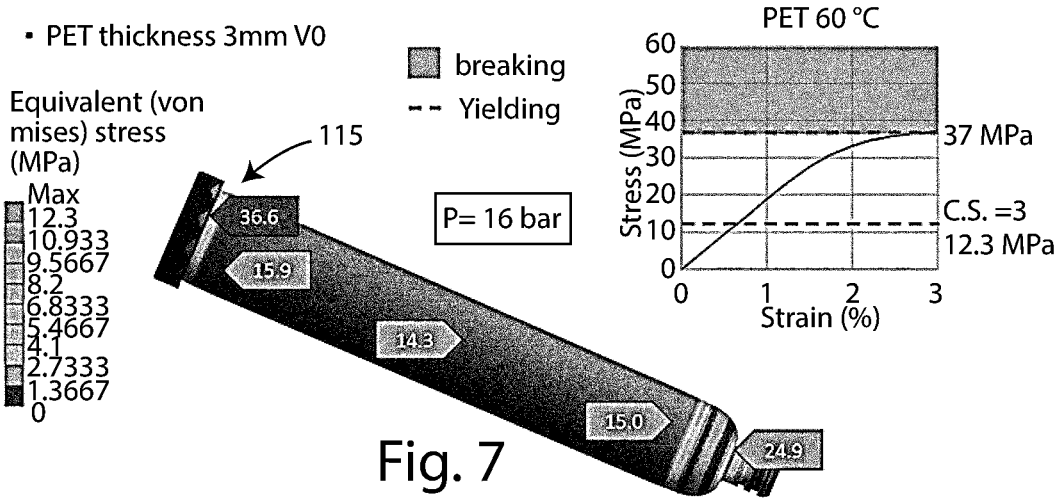
FIGS. 7 and 8 show, respectively, the test results on the withstanding of external stresses of two variants of expansion vessels.

In particular, FIG. 7 shows the results of a test on a main body provided with ribs 115 made differently from what is described above, that is to say, flat and with a height equal to that of the edge 11, so as not to be projecting, nor falling within the latter. The system was externally stressed by a predetermined operating pressure, initially equal to up to 16 bar; in this case the structure of the expansion vessel was found to be more stressed than that found for the solution of interest, which will be described below.

In fact, in the case in question, an equivalent stress of the system of 36.6 MPa is reached, a value which is very high considering that, according to the case study, the yield strength of the material would occur around 37 MPa, so much so that, with this specific geometry, even by marginally decreasing the operating pressure, this is not sufficient to achieve better results.

In detail, the coefficient of 37 MPa is considered as a threshold value/upper limit or also as a safety factor in which, compared to it, the most acceptable value is the lowest possible.

Figure 8:
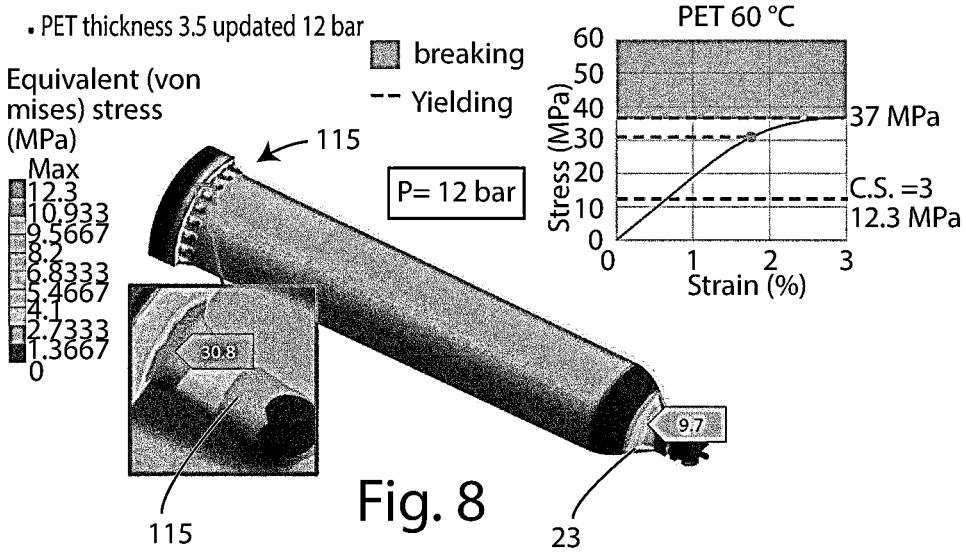

The same example applies, with reference to FIG. 8, in the case in which the ribs 115 have been made in a manner projecting with respect to the compartment 114 to the edge 11, and for a portion attached only to the main body 1.

In this case, the system was externally stressed by a pressure of up to 12 bar (that is, the operating pressure of the expansion vessels in question) and the structure of the expansion vessel was stressed, with a lower value than the solution in FIG. 7, that is up to an equivalent stress of 30.8 MPa, a value which is still too high considering that, as previously mentioned, the yield of the material occurs at around 37 MPa.

What has just been described in the above-mentioned examples is not compatible with the specific technical sector since, as the expansion vessels are subject to cyclic external stresses, they must be able to withstand them as well as possible and, this last configuration, it would lead to the failure of the system more easily and faster.

In particular, the criterion of maximum distortion or Von Mises criterion was applied, which assumes that the yield of the material is reached when the distortion energy reaches a limit value (where the distortion is the component of the deformation that causes a variation in the shape, but not in volume, of the volume element).

Figure 9:
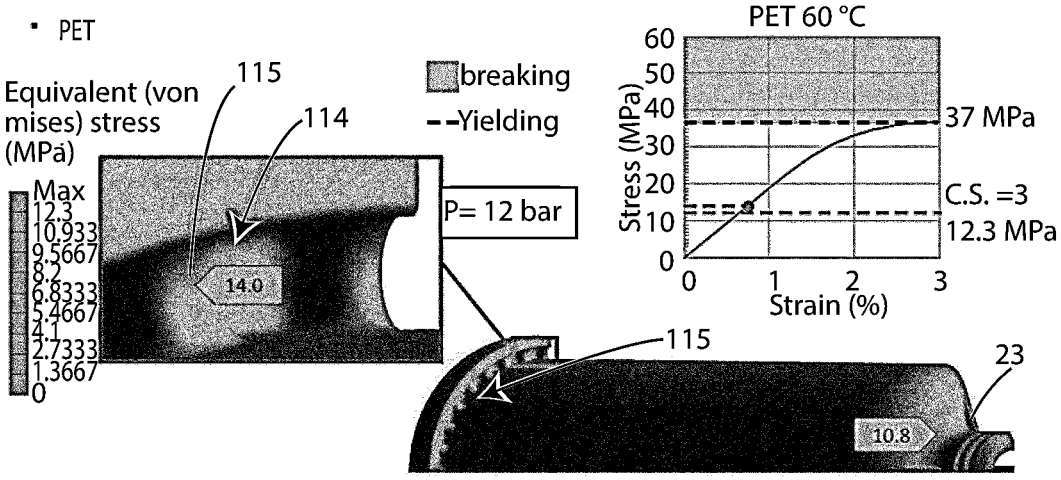
FIG. 9 schematically shows the test results relating to the withstanding of external stresses exerted on the structure of the expansion vessel.

As can be seen in FIG. 9, making the ribs 115 inside the compartment 114, as described above, in a recessed manner with respect to the plane A itself, has meant that, when the system has been externally stressed by a pressure of up to 12 bar, it responded to the stress in an optimal manner, stressing and deforming with difficulty and less than in the cases described above (FIGS. 7 and 8), that is to say, in cases in which the ribs 115 were flat or projecting with respect to the compartment 114 of the edge 11.

In particular, the ribs 115 of the expansion vessel with an external pressure applied as in the case study, that is, 12 bar, reach an equivalent stress of about 14 MPa, which is the lowest value found in the various tests and which differs greatly from the yield threshold of the material, which is equal to 37 MPa, thus making the system safer.

For this reason, the particular configuration of the ribs 115, described in the embodiment in question of the expansion vessel is essential for guaranteeing the resistance and optimal operation of the expansion vessel itself.

Figure 10:
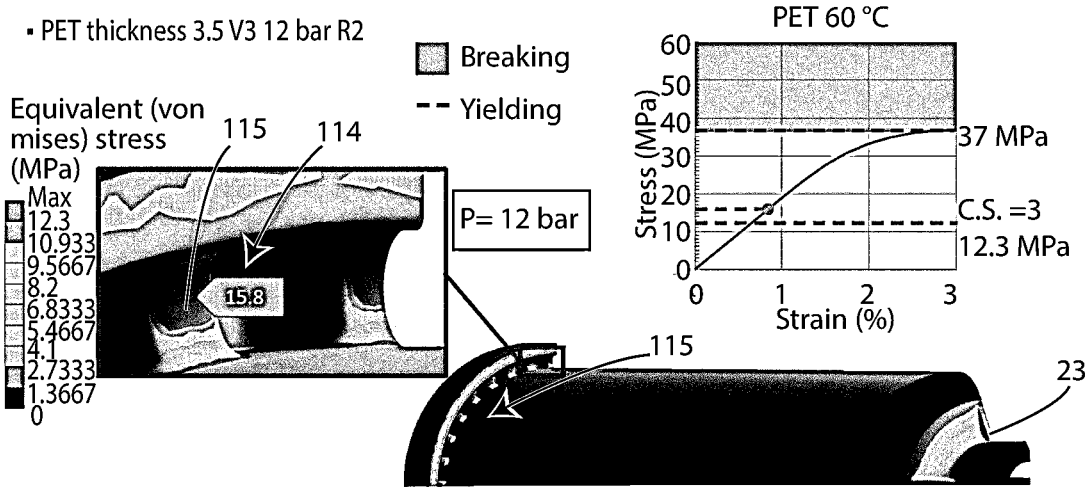
FIGS. 10-12 schematically show the test results relating to the withstanding of external stresses exerted on further variants of the structure of the expansion vessel.
Figure 11:
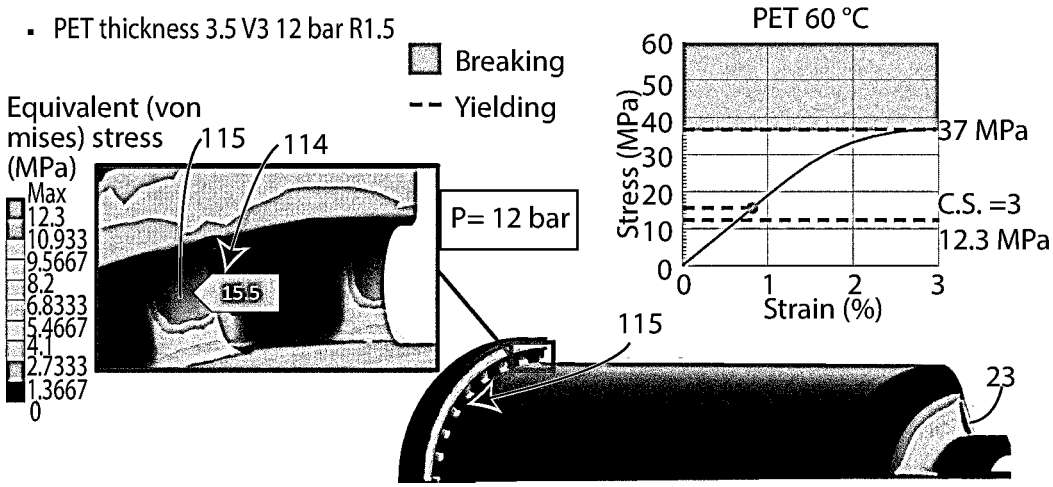
Figure 12:
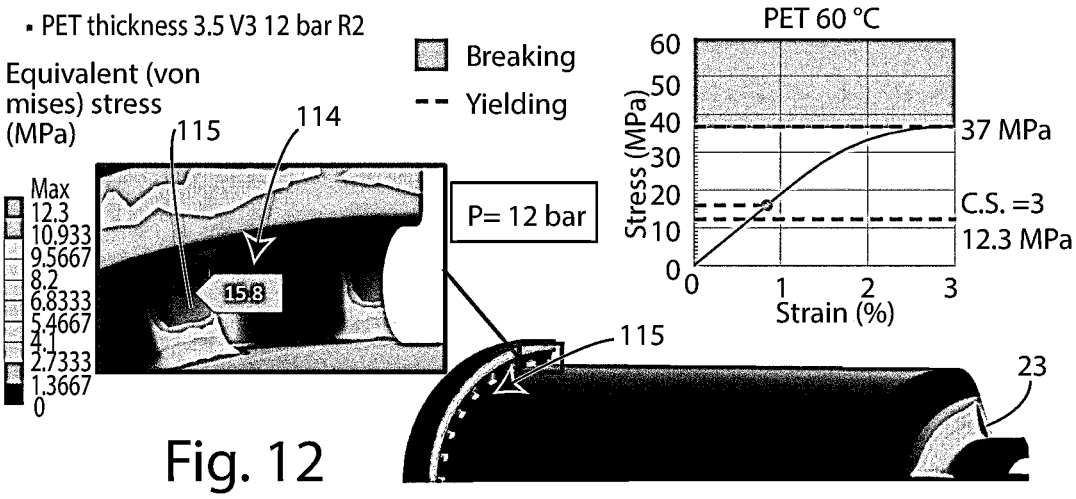

In fact, further tests were carried out on geometries similar to that of FIG. 9, by varying the height of the ribs 115 inside the compartment 114, while maintaining the substantially curvilinear concave shape and only minimal variations of the equivalent stress values were found. (FIGS. 10, 11 and 12 where the numerical references refer to the same elements already mentioned for FIG. 9).

Again with reference to the same study (FIGS. 7-12), it was noted that the formation of the support means 23, placed around the base of the inlet 2 of the liquid inlet, also allows the system stressed by an external pressure, as visible in FIGS. 8 and 9, to respond with an equivalent stress of around 9/10 MPa.

The above does not occur if the support means 23 are not present, as shown in FIG. 7, in which the equivalent stress reaches 24.9 MPa. For this reason, this configuration is also considered to help further improve the response of the expansion vessel to the external stresses it will encounter. Again at the edge 11 of the main body 1 there is a covering cap 7, for example made of steel, with a substantially elliptical shape, in such a way as to contain the loads of the expansion vessel, having a central hole at the valve 3 for the gas inlet, so that the valve 3 of the system can be inserted inside it for the operation of the expansion vessel.

As can be seen in detail in FIG. 1B, the above-mentioned cap 7 in turn comprises a second edge 71, made in such a way as to follow the profile of the first edge 11, attaching onto it through a flap 72, for example with a hook. Advantageously, the above-mentioned configuration allows the membrane 4 to be blocked inside the expansion vessel, putting it in communication, for example, with the valve 3 for the gas inlet.

In addition, in a further embodiment a first ring 5 can be provided, for example made of steel, at the area between the flap 72 of the cap 7 and the edge 11 of the main body 1, as visible in FIG. 1B.

Again advantageously, the above-mentioned first ring 5 makes it possible to facilitate the checks under stress of the expansion vessel, the distribution of the stresses and, generally, to strengthen the structure since, at the flap 72, the material that constitutes the cap 7 could be thinner and therefore less resistant to any stresses.

Figure 6:
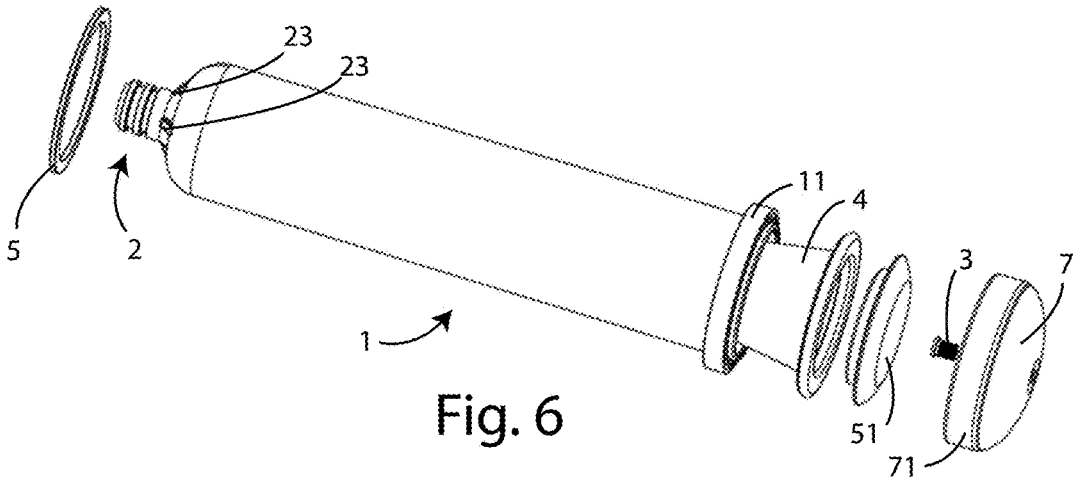
FIG. 6 is a perspective and exploded view of the expansion vessel of FIG. 1.

Moreover, between the cap 7 and the membrane 4 there is a second ring 51, for example made of plastic, as visible in FIGS. 1B and 6, with the aim of holding the membrane 4 in position with respect to the cap 7.

In particular, due to its particular positioning, the second plastic ring 51 makes it possible to create a space between the cap 7 and the membrane 4 so that the latter, while remaining in position, can in any case contract and expand freely during the use of the expansion vessel, with a consequent optimization of the operation.

According to a further variant of the first embodiment, the expansion vessel made of plastic material with a membrane 4 (FIGS. 1-6) has the relative elements in an inverted position with respect to what was described above and with respect to the sides of the main body.

Therefore, the inlet 2 for liquid, for example water, is located above the installation position of the vessel, and the valve 3 for the inlet of gas, for example air, is located below the installation position of the vessel.

In particular, in the first embodiment thereof, the operation of the plastic material expansion vessel that is the object of some embodiments of this disclosure is substantially the following.

In the non-use position, the elastic membrane 4 is completely extended and full of air coming from the gas inlet valve 3; for this reason, said membrane 4 is substantially in contact with the walls of said main body 1 and the inlet 2 for the liquid is completely obstructed by the overall dimensions of said membrane 4 full of air.

During the step of filling or emptying the expansion vessel, through a variation of the pressure of the air entering from said gas inlet valve 3, there is an increase or decrease of the volume occupied by the water outside said elastic membrane 4 and inside the walls of the main body 1, entering from said inlet 2 for liquid.

Lastly, the method for manufacturing the expansion vessel, according to some of embodiments of the disclosure, advantageously comprises at least the following steps:

- a first step of injection molding of the molten plastic, at high pressure, inside a mold, with the creation of a main body 1 equipped with a sprue 22;
- a second step for making at least two holes 21 equidistant with respect to the sprue 22, close to the sprue 22 itself, designed for inserting the plastic material inside the mold to form the main body 1 of the expansion vessel;
- centering the male-matrix of the mold on said at least two holes 21;
- cooling of the melted plastic inside the mold and opening of the mold for the extraction of the expansion vessel thus created;
- insertion of the membrane 4 at the edge 11 of the main body 1;
- possible compression and rolling of the edge 11 with the ring 5 or closure by means of molding and/or pressing welding of the main body 1 and of the cap 7;
- permanently closing the cap 7, previously equipped/prepared with a valve for inserting the gas 3.

In this way, an expansion vessel made of plastic material with a membrane made from plastic material is obtained.

The expansion vessel thus created, as described above and according to the examples illustrated in detail in the accompanying FIGS. 1, 2, 3, 4 and 5, therefore has:

- simplicity and speed in the assembly and disassembly operations of the membrane;
- reliability and safety in use, as compared to known solutions;
- suitability to contain drinking water;
- safety from the point of view of water contamination;
- greater robustness than known solutions;
- versatility and adaptability to any type of situation and volume of liquid to be contained;
- greater resistance of the expansion vessel itself;
- ease in transport processes;
- resistance to sudden temperature changes and UV rays;
- limited cost, as compared to traditional solutions, in relation to the benefits achieved.

The disclosure described can be modified and adapted in several ways without thereby departing from the scope of the inventive concept.

Further, all the details can be replaced by other technically-equivalent elements.

Lastly, the components used, providing they are compatible with the specific use, as well as the dimensions, may vary according to requirements and the prior art.

Where the characteristics and the techniques mentioned in the following claims are followed by reference signs, such reference signs have been used only with the aim of increasing the intelligibility of the claims themselves and, consequently, the reference signs do not constitute in any way a limitation to the interpretation of each element identified, purely by way of example, by the reference signs.

What is claimed is:

1. An expansion vessel for containing and dispensing a liquid by compression of a gas, the expansion vessel comprising:

a main body comprising a first end and a second end and comprising a first edge at said first end, overhanging with respect to said main body;

wherein said first edge has a substantially "L" shape providing with said main body a compartment having a "U" shape and an opening facing the second end and said opening defining a plane perpendicular to said main body, and the compartment comprises a plurality of reinforcing ribs recessed with respect to said plane and to said first edge.

2. The expansion vessel of claim 1, wherein said ribs have a profile, substantially curvilinear.

3. The expansion vessel of claim 1, wherein said main body comprises:

a sprue resulting from an injection attachment and at least two holes equidistant from each other and placed around said sprue.

4. The expansion vessel of claim 1, wherein said main body comprises at the second end an inlet for a liquid around which there are a plurality of support means equidistant from each other.

5. The expansion vessel of claim 1, further comprising a membrane comprising a second edge and, at said first edge:

the second edge of the membrane, and a cover cap, substantially elliptical in shape and made of steel, for fixing said second edge of the membrane, comprising a third edge with a larger diameter than said cover cap, such as to structurally follow a profile of said first edge.

6. The expansion vessel of claim 5, wherein said third edge includes a hooked flap for engaging said cover cap to said first edge of said main body.

7. The expansion vessel of claim 6, further comprising, at a first area between said flap of said cover cap and said first edge of said main body, a first steel ring so as to strengthen the structure of said cap.

8. The expansion vessel of claim 5, wherein said main body includes a valve for inlet of gas, and wherein said cover cap comprises a central hole for inserting said valve.

9. The expansion vessel of claim 5, further comprising, at a second area between said cover cap and said membrane a second plastic ring configured to hold said membrane in position relative to said cover cap during operation of said expansion vessel.

10. The expansion vessel of claim 1 wherein said main body is one piece.

11. The expansion vessel of claim 1, wherein said main body comprises integrated support means suitable for supporting said main body.

12. A system pump comprising the expansion vessel of claim 1.

13. A method for making the expansion vessel of claim 1, the method comprising following steps:

injection molding of molten plastic material, under high pressure, within a mold, whereby a main body provided with a sprue is made;

creation of at least two holes equidistant from the sprue, near the sprue itself, configured for inserting the plastic material inside the mold for the molding of the main body of an expansion tank; and centering of male-matrix of the mold on said at least two holes.

* * * * *